United States Patent [19]

Dorner et al.

[11] 4,014,749

[45] Mar. 29, 1977

[54] TUBE FURNACE FOR THE CRACKING OF ORGANIC FEED STOCK

[75] Inventors: Armin Dorner; Walter Kreuter, both of Munich, Germany

[73] Assignee: Linde Aktiengesellschaft, Wiesbaden, Germany

[22] Filed: Apr. 22, 1974

[21] Appl. No.: 463,103

[30] Foreign Application Priority Data

Apr. 25, 1973 Germany ..... 2320872

[52] U.S. Cl. ..... 196/116; 122/235 C; 122/235 K; 122/356; 196/110

[51] Int. Cl.[2] ..... C10G 9/20; F22B 21/24; F22B 37/12

[58] Field of Search ..... 196/110, 116; 23/277 R, 23/262; 122/235 C, 235 K, 333, 356

[56] References Cited

UNITED STATES PATENTS

| | | | |
|---|---|---|---|
| 1,889,861 | 12/1932 | Huet | 122/356 X |
| 2,487,324 | 11/1949 | Forseth | 196/116 UX |
| 2,698,349 | 12/1954 | Bills | 23/277 R X |
| 2,994,724 | 8/1961 | Hillard, Jr. et al. | 23/277 R UX |
| 3,269,363 | 8/1966 | Guerrieri | 122/356 |
| 3,291,104 | 12/1966 | Zimmerman | 122/356 X |
| 3,407,789 | 10/1968 | Hallee et al. | 196/116 X |
| 3,453,087 | 7/1969 | Herp, Jr. et al. | 23/277 R X |
| 3,572,999 | 3/1971 | Sato | 196/116 X |
| 3,630,850 | 12/1971 | Dorresteyn | 196/116 X |

*Primary Examiner*—Morris O. Wolk
*Assistant Examiner*—Michael S. Marcus
*Attorney, Agent, or Firm*—Karl F. Ross; Herbert Dubno

[57] ABSTRACT

A tube furnace for the cracking of organic feed stock, e.g. naphtha to ethylene, comprises a chamber traversed by at least one conduit system for the organic feed stock. The conduit system in the region of the inlet comprises a plurality of pipes which are united at an intermediate location and communicate jointly with a single pipe forming the discharge portion of the duct system. Preferably the flow cross section of the duct system increases from the inlet to the outlet end. Burners are provided in the wall of the chamber.

4 Claims, 5 Drawing Figures

TUBE FURNACE FOR THE CRACKING OF ORGANIC FEED STOCK

FIELD OF THE INVENTION

The present invention relates to a tube furnace for the thermal cracking of hydrocarbon and like organic feed stocks, especially naphtha to ethylene.

BACKGROUND OF THE INVENTION

In the usual tube furnace for the thermal cracking of organic compounds, a duct system consisting of a single tube in the form of a meander, coil or other undulating arrangement of tube passes traverses a furnace chamber in the walls of which burners are mounted, the tube being of constant cross section from its inlet end to its outlet end.

Such tube furnaces have been provided heretofore for the thermal cracking of hydrocarbons such as naphtha and use burners arrayed on the walls of the combustion chamber in which the tube is arranged. The tube generally is looped to provide the numerous passes which are desirable in a small volume.

Above the combustion chamber a convection zone is commonly provided in which the hydrocarbon is, before entering the tube coil of the combustion chamber, preheated by the combustion gases to a temperature below that at which significant cracking occurs.

The cracking process is dependent upon the temperature to which the hydrocarbon is heated and the residence time of the hydrocarbon in the combustion chamber and hence the yield of cracking products, such as ethylene, is found to depend upon the increased temperature and a short residence time.

The short residence time is desirable to prevent secondary reactions of the primary desired product, the secondary reactions resulting in the formation of high-molecular-weight products. While the simple solution to the problem of increasing the yield of the desired product might appear to be the shortening of the residence time and the increasing of the temperature, it is found that the temperature has a maximum above which further increase in temperature will not increase the yield of the desired product. Concommittently the residence time has a lower limit below which cracking diminishes or does not appreciably occur. Hence a minimum residence time and a maximum cracking temperature must be observed.

With conventional systems of the character described, however, the throughput is limited and difficulties in controlling the system are encountered because of the criticality of the parameters at which the system must operate.

OBJECTS OF THE INVENTION

It is the principal object of the present invention to provide an improved tube furnace, especially for the cracking of organic compounds such as hydrocarbons to low-molecular-weight compounds.

Another object of the invention is to provide a tube furnace which at relatively low cost will have a higher effective throughput than the prior-art tube furnace.

SUMMARY OF THE INVENTION

These objects and others which will become apparent hereinafter are attained, in accordance with the present invention by providing a tube furnace for the purposes described which comprises a combustion chamber and at least one duct system traversing this chamber, the duct system having an inlet side and an outlet side, the inlet side of the duct system being formed with a plurality of discrete tube portions running parallel to one another (i.e. conducting the hydrocarbon in parallel) and communicating with a common pipe at an intermediate location along the system, the common pipe forming the outlet portion of the duct system.

In other words, within the combustion chamber, two pipes form a portion of the duct system and are united to feed a single pipe with a correspondingly larger flow cross section.

Since the total surface area of the two pipes forming the inlet side of the system is greater for a given flow cross section than the surface area of a single pipe with the same total cross section, in the inlet portion the duct system has a greater heat exchange surface so that heat can be transferred more rapidly through the walls of the pipes to the medium traversing same. Since the transferred heat quantity is directly proportional to the heat-transfer area, for a given temperature of the furnace, more heat can thus be transferred to the hydrocarbon so that a reduction of the residence time and an increase in the throughput volume is possible.

According to another feature of the present invention the ratio of heat exchange surface area to flow cross section is decreased from the inlet side to the outlet side, advantageously by making the two or more tubes constituting the inlet end and the single tube constituting the outlet end of progressively greater diameter or radius. It will be appreciated that the cross sectional area increases as the square of the radius of the tube while the heat exchange area increases linearly with the radius so that an increase in the cross section of each tube will result in a decrease in the ratio of heat exchange surface area to flow cross section from the inlet side to the outlet side of the device.

At this case, unlike the conventional system in which the flow cross section is substantially constant over the entire duct system, the flow cross section can progressively be increased and the maximum temperature of the fluid to be cracked reaches a maximum level at an intermediate point in the duct system rather than in the discharge end thereof.

Since the hydrocarbon flow through the duct system is initially subdivided into two or more parallel paths, each traversing a respectial tube section, there is initially a higher effective heat transfer surface per unit quantity of the fluid to be treated and the greater heat-transfer area results in a rapid transfer of heat from the combustion chamber to the fluid. With an increasing duct cross section the temperature of the fluid may be held generally constant or may have only a slight increase as the fluid traverses the furnace. The duration over which the hydrocarbon is at the maximum temperature is therefore greater and a correspondingly improved thermal cracking results.

It has been found to be especially advantageous to provide the tube coils or turns such that the major stretches of the tube lie substantially vertically.

It has been found to be advantageous to provide the duct system in a horizontally elongated combustion chamber of double-T cross section (in a horizontal plane) and to provide two duct systems having their outlets at a central portion of the furnace chamber and their inlets in respective antechambers at the ends of the double-T, each duct system being formed with two or more tubes in the respective antechamber which runs generally transversely to the rectangular-cross section central chamber.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
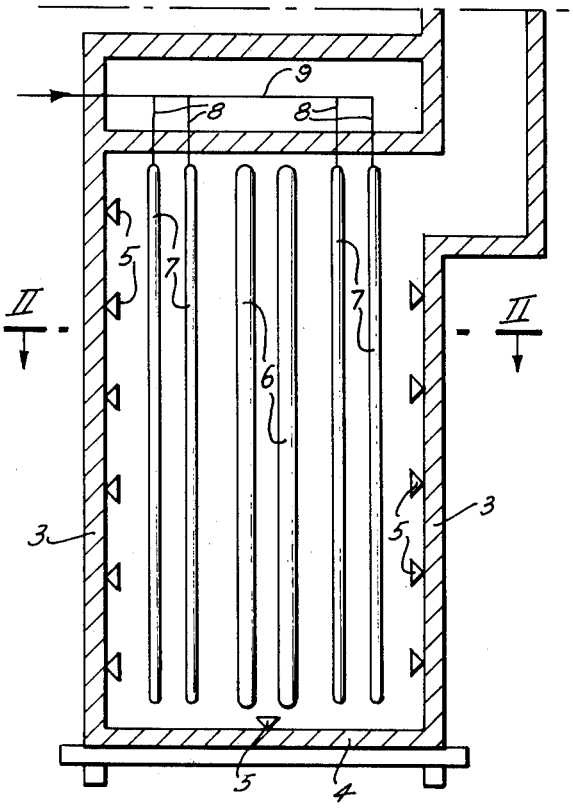
FIG. 1 is a vertical cross sectional view through the central chamber of a double-T tube furnace embodying the present invention.
Figure 2:
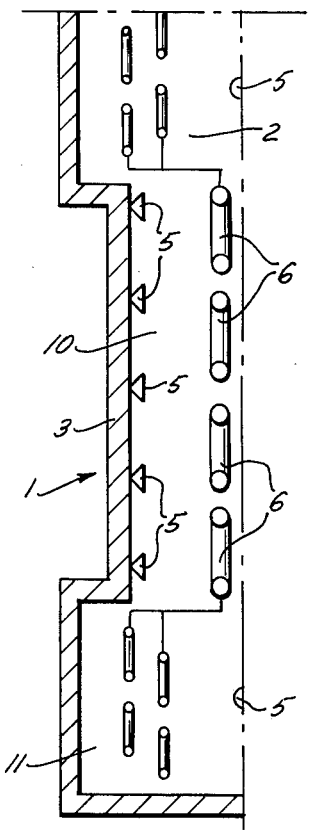
FIG. 2 is a section taken generally along the line II—II of FIG. 1; showing only half of the double-T shape of the furnace.

In the drawing we show a tube furnace 1 for the thermal cracking of naphtha and other hydrocarbons which comprises a combustion chamber 2 of double-T cross section as viewed in a horizontal plane (see FIG. 2 in which only the left hand half of the furnace is shown, the right hand half being mirror symmetrical therewith.

The walls of the combustion chamber 2 are provided with burners 5 of a fuel-oil or gas type and at least one duct system (in the embodiment shown, two duct systems) consisting of tubes 6 and 7 is provided within the combustion chamber in the form of tube coils or meanders with substantially vertical passes or stretches. The tube portion 6 has a greater flow cross section than the two parallel tube sections 7, which are united in the tube portion 6.

The tubes 7 are connected by a manifold 8 to the feed pipe 9 located externally of the combustion chamber.

The horizontally elongated double-T combustion chamber comprises a central rectangular compartment 10 and a pair of end compartments or antechambers 11 which extend transversely to the direction in which the main chamber 10 extends. The tubes 7 of smaller cross section are disposed in the transverse antechambers 11 and joined together upon opening into the tube portion 6.

Figure 3:
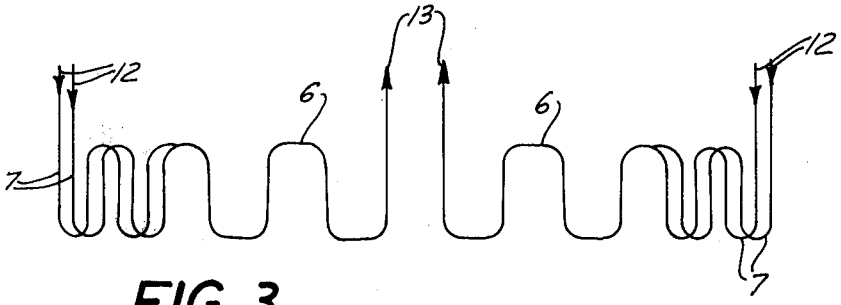
FIG. 3 is a diagram showing the tube coils according to the invention.
Figure 5:
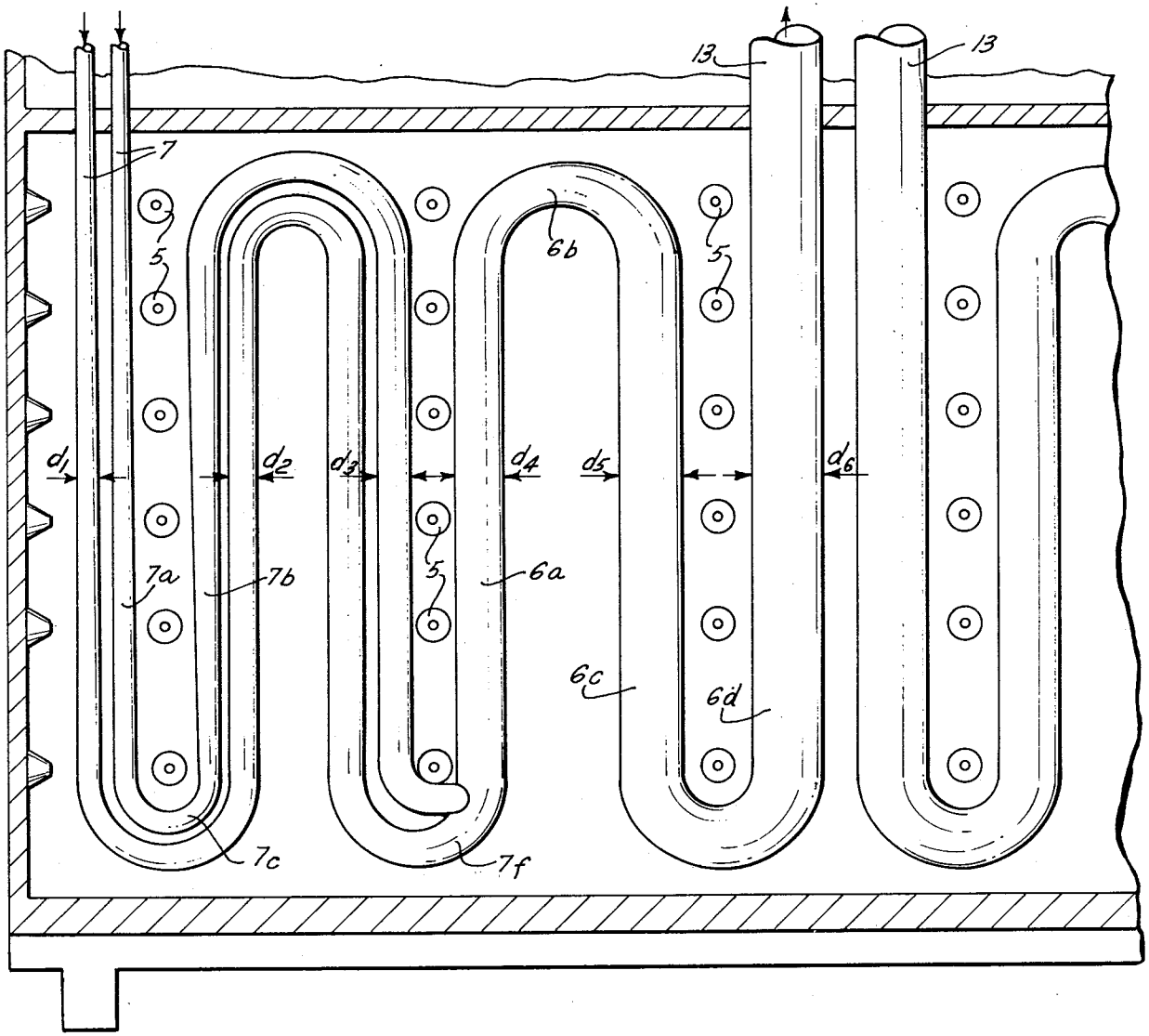
FIG. 5 is a vertical section taken in a plane perpendicular to the section line II-II of FIG. 1.

FIGS. 3 and 5 show the uniting of the two tubes 7 and the flow direction of the hydrocarbon more or less diagrammatically (arrow 12). The cracked hydrocarbon and cracking products are discharged from the outlet of the tube portion 6 in the direction of the arrow 13. Each of the two tubes 7 of each duct system 6, may comprise a vertical stretch 7*a* having a flow cross section of a diameter which, for example, may be represented as $d_1$. A bight 7*c* connects the vertical stretch 7*a* to a vertical stretch 7*b* whose slow cross section may be determined by the diameter $d_2$, always considering the wall thickness of the tube to be constant. A further bight, 7*b* connects the tube portion 7*b* to a vertical path 7*e* of diameter $d_3$, bight 7*f* uniting the flow from the tube 7 to the tube portion 6 which has an upwardly extending vertical stretch 6*a* connected by a bight 6*b* to the vertical stretch 6*c*. The latter reaches to the outlet portion 6*d*. The diameters, $d_4$, $d_5$, and $d_6$ progressively increase as do the diameters $d$, $d_1$, $d_2$, and $d_3$ while the flow cross section of diameter $d_4$ is equal at least to twice the flow course section at diameter $d_3$.

Figure 4:
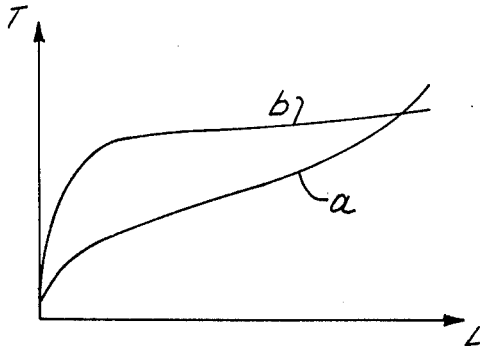
FIG. 4 is a graph relevant to the functioning of the apparatus.

FIG. 4 shows a diagram in which the temperature of the hydrocarbon T is plotted along the ordinate against the tube length L plotted along the abscissa. The curve *a* represents the temperature of the medium traverses the tubes in accordance with the conventional system while curve *b* represents the temperature relationship according to the invention. Thus with the claimed system the hydrocarbon is heated to close to the final temperature immediately upon starting and the discharge temperature is only slightly above the starting temperature. By contrast, the temperature of the hydrocarbon reaches close to its maximum only just before discharge from the tubes.

With the system of the present invention, therefore, substantially constant thermal conditions are maintained for the medium over the major portion of the length of the tube and there is no point at which overheating of the tube matters or of the hydrocarbon above the permissible level can occur.

We claim:

1. A tube furnace for the thermal cracking of hydrocarbon comprising a combustion chamber, a plurality of duct systems traversing said chamber for conducting a hydrocarbon therethrough, each duct system having an inlet side and an outlet side, each duct system comprising at said inlet side at least two tubes in said chamber of undulating configuration each with a plurality of loops in mutually parallel vertical planes for conducting said hydrocarbon in parallel and, at said outlet side, a common pipe in said chamber of undulating configuration with a plurality of loops in a vertical plane parallel to the vertical planes of said tubes and communicating with said tubes, said tubes opening into and connected to said pipe and forming a junction therebetween, said pipe being of a flow cross section at least equal to that of said tubes at their junction with said pipe, said tubes and said pipes having substantially vertical stretches constituting the major part of their respective lengths, said chamber being of double-T cross section in a horizontal plane and comprises a central compartment and a pair of end compartments lying transverse to said central compartment, two such duct systems being provided in said chamber with their respective tubes disposed in said end compartment and their respective pipes lying in said central compartment, said chamber being formed by vertical walls, burners being mounted on said walls, said loops lying in planes parallel to said walls.

2. The tube furnace defined in claim 1 wherein said pipe has a flow cross section greater than the sum of the flow cross sections of said tubes at said junction.

3. The tube furnace defined in claim 1 wherein the flow cross section of said tubes increases in the direction of said junction and the flow cross section of said pipe increasing from said junction towards said outlet side.

4. The tube furnace defined in claim 1 wherein the flow cross section of the tubes of each duct system increases progressively from the respective inlet side to the respective junction, and the flow cross sections of each pipe of the respective duct systems increase progressively toward the outlet side from the respective junction.

* * * * *